US005857220A

United States Patent [19]

Erny et al.

[11] Patent Number: 5,857,220

[45] Date of Patent: Jan. 12, 1999

[54] STRAP LOGO

[75] Inventors: Albert W. Erny; Linda H. Clower, both of Louisville, Ky.

[73] Assignee: C & E Products LLC, Louisville, Ky.

[21] Appl. No.: 916,814

[22] Filed: Aug. 22, 1997

[51] Int. Cl.[6] ..... A41D 27/08

[52] U.S. Cl. ..... 2/244; 2/209.13; 2/245; 36/136; 40/329

[58] Field of Search ..... 2/209.13, 244, 2/245, 246; 36/136; 40/329, 586, 633, 640, 665, 904; 446/26, 27, 28, 77, 227

[56] References Cited

U.S. PATENT DOCUMENTS 4,936,699 6/1990 Yoshida ..... 446/26
5,499,402 3/1996 Rose ..... 2/209.13

*Primary Examiner*—Diana L. Biefeld
*Attorney, Agent, or Firm*—Donald L. Cox; Scott R. Cox

[57] ABSTRACT

A strap logo for a user to apply to the strap of a bag, cap, to shoestrings, or other articles having a linearly extended member comprises a logo face rotably attached to arms which encircle the strap and are, in turn, attached to each other by complementary hook and loop fastening means. As constructed, the strap logo may be temporarily attached to a variety of straps and removed at the user's option.

6 Claims, 2 Drawing Sheets

STRAP LOGO

BACKGROUND OF INVENTION

This invention relates to means for attaching logos to user items. More particularly, this invention relates to a means for temporarily attaching a variety of logos to user devices such as bags or hats which contain straps.

A wide variety of logo attachment means are available in the prior art. Most of these logo attachment means or attached to hats, such as, for example, the logo attachment means disclosed in U.S. Pat. No. 5,003,640, which involves attaching a logo to the straps on the back of a cap for purposes of obscuring the straps. Other examples of cap logo attachment means are disclosed in U.S. Pat. No. 5,517,695.

U.S. Pat. No. 5,499,402 discloses an attachment to the adjustable strap on a baseball cap. In FIGS. 4 and 5, the patent discloses the use of complementary snaps to interchange patches applied to adjustable straps on baseball caps. No disclosure is made of a rotable logo which is permanently attached to hook and loop fastener encircling arms.

Accordingly, it is an object of this invention to prepare a strap logo which may be applied to a wide variety of straps, caps, bags or other articles having linearly extended members which may receive a logo.

It is another object of this invention to prepare a strap logo wherein the logo may be rotated about an axis on the strap encircling arms so as to control the orientation of the logo.

It is another object of this invention to prepare a readily attachable and removable strap logo which may be applied to a wide variety of articles. These and other objectives are obtained by the instant invention.

SUMMARY OF INVENTION

The instant invention comprises a strap logo having a band for encircling a strap. The band is formed from arms, each of which have complementary hook and loop fasteners attached to each end which may be attached one to the other so as to form a loop for encircling a strap. Attached to the band is a face member which has an inner face rotably and permanently attached to the band and an outer face on which a logo is applied.

DETAILED DESCRIPTION OF PREFERRED EMBODIMENTS

Figure 2:
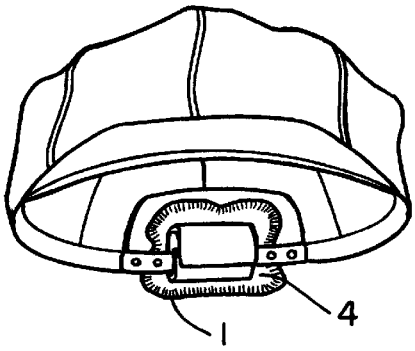
FIG. 2 is a front elevational view of the strap logo of the instant invention in place on a hat.
Figure 3:
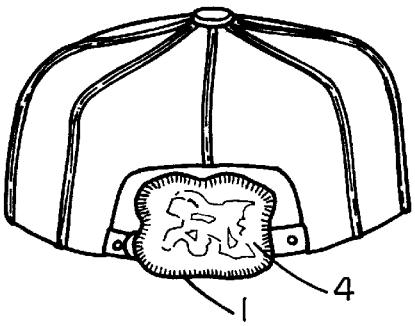
FIG. 3 is a rear elevational view of the strap logo of the instant invention in place on a hat.
Figure 4:
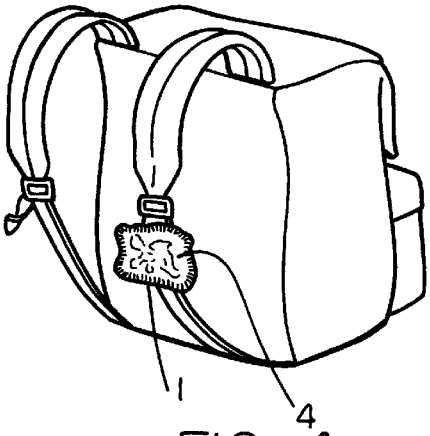
FIG. 4 shows the strap logo of the instant invention in place on a book bag.
Figure 5:
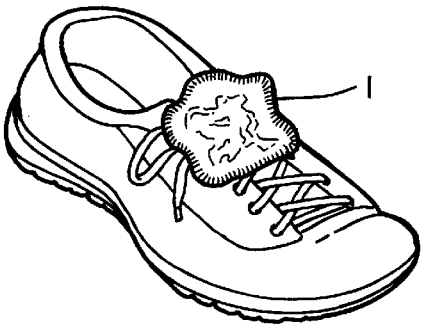
FIG. 5 shows the strap log of the instant invention in place on shoestrings.

As shown in the drawings, the instant invention involves a strap logo (1). Although, the strap logo is shown respectively in FIGS. 1–3, attached to a baseball cap, in FIG. 4, attached to a book bag, and in FIG. 5 attached to shoe strings, the strap logo of the instant invention may be attached to anything which provides a strap of longitudinally extended member around which a band may be wrapped. Thus, the instant invention is also applicable to belt loops, epaulets, belts, luggage straps and any other similar banded devices.

Figure 1:
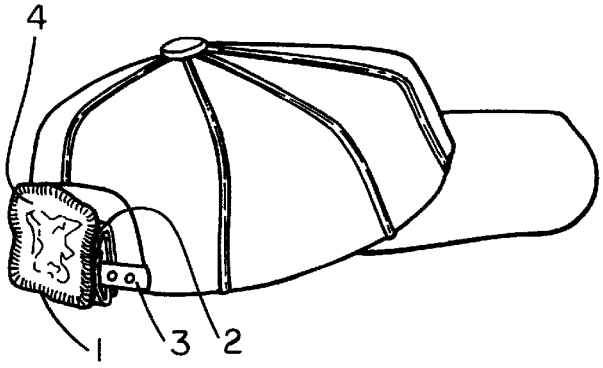
FIG. 1 is a prospective view of the strap logo of the instant invention in place on a cap adjustment strap.

The strap logo (1) of the instant invention as shown in FIG. 1 includes a band (2) which is longitudinally extended and is of sufficient length to wrap around the adjustable cap strap (3) to which the strap logo is to be attached. The width of the band is immaterial. It should only be of sufficient width to readily support the logo described hereafter. Accordingly, the band (2) may be as small as ¼ the width of the logo face (4); as large as the size of the logo or even larger. However, for ease of manufacturing, in general, the smaller the width of the band the better.

Figure 6:
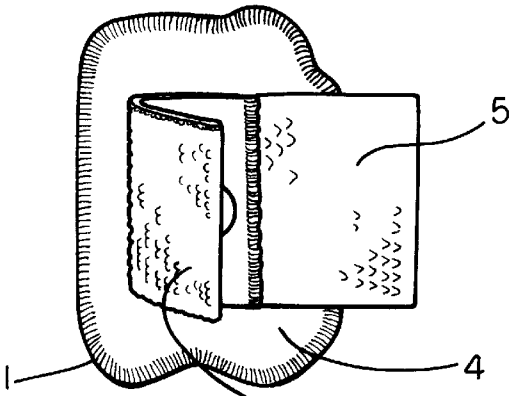
FIG. 6 is a rear view of the strap logo of the instant invention with the arms displayed in an "open" fashion.
Figure 7:
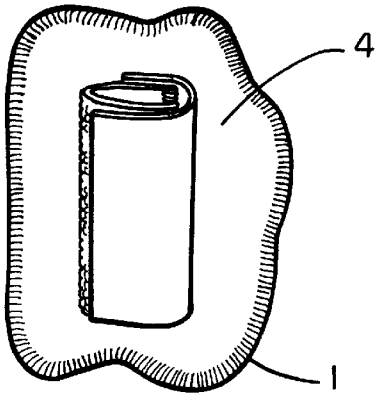
FIG. 7 is a rear view of the strap logo of the instant invention with the arms wrapped one about the other.

As further shown in FIGS. 6 and 7, the band (2) of the instant invention should have complimentary hook and loop fastener (5) and (6) attached on its arms such that when the band is folded over as shown in FIG. 7 and the front surface of the hook and loop fastener of one arm (5) comes into contact with the back surface of the hook and loop fastener of the other arm (6), it will not readily detach.

In applying the hook and loop fastener face to the band it is not necessary that the entire length of the band be provided with the hook and loop fastener material. Rather, it is only those complementary areas which come into contact with each other which must absolutely have hook and loop fastener present. Where, however, it is desired that the arms be adjustable so as to permit attachment to smaller or larger sized straps providing along most of the length of the arms is desirable. And for manufacturing convenience, it is easier simply to manufacture the band having full hook and loop fastener faces on both sides of the arms.

Figure 9:
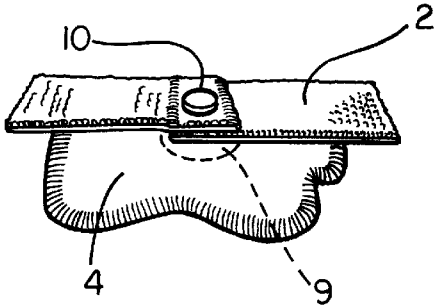
FIG. 9 shows the rivet in place holding the arms and the logo together.

As particularly shown in FIG. 9, the band is rotably and permanently attached to the logo face (4). It is necessary that the attachment permit the logo to rotate and that the means of attachment be permanent such that the logo cannot be removed. Rotable attachment of the face member to the band assures that the face member may be adjusted in any convenient fashion so that the particular logo which appears on the opposite face of the face member may be up, down or sideways.

Figure 8A:
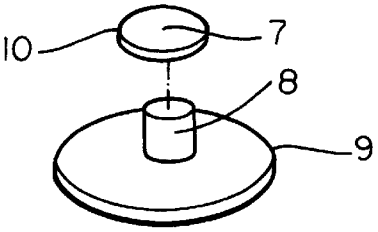
FIGS. 8A and 8B show perspective views of the strap rivet which is used to attach the arms to the logo.
Figure 8B:
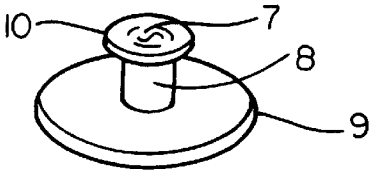

The most preferred means of attachments is a rivet as shown in FIGS. 8A, 8B and 9.

The rivet assembly, as shown in FIGS. 8A and 8B is comprised of a rivet base (9) a rivet stem (8) and a rivet cap (7). The rivet base (9) is permanently affixed to the logo face by implantation, gluing or other means of attachment. Holes then are punched or otherwise formed in the arms, the rivet stem (8) is inserted, the rivet cap (7) is put in place and the rivet compressed so as to permanently affix the arm to the logo face. As a result of this means of construction, the arms are freely rotable about the logo face.

The logo itself may be of any particular form or shape. However, in general, the larger the logo, to a certain extent, the larger the band must be in order to support the logo.

What is claimed is:

1. A strap logo comprising a band having arms for encircling a strap or other linearly extended member, and having complementary hook and loop fasteners attached to each of said arms and a logo face having inner and outer faces, said inner face being permanently and rotably attached to said band and said outer face having a logo applied thereto.

2. The strap logo of claim 1 wherein the logo face member is rotably attached to the band by means of a rivet having a rivet head, a rivet stem and a rivet base wherein said base is attached to the logo face and wherein said arms are ratably secured to the stem by means of the rivet cap.

3. A strap logo comprising a band having arms for encircling a purse or luggage strap, and having complementary hook and loop fasteners attached to each of said arms and a logo face having inner and outer faces, said inner face being permanently and rotably attached to said band and said outer face having a logo applied thereto.

4. A strap logo comprising a band having arms for encircling an adjustable strap on the back of a baseball-type cap, and having complementary hook and loop fasteners attached to each of said arms and a logo face having inner and outer faces, said inner face being permanently and rotably attached to said band and said outer face having a logo applied thereto.

5. A strap logo comprising a band having arms for encircling a shoestring, and having complementary hook and loop fasteners attached to each of said arms and a logo face having inner and outer faces, said inner face being permanently and rotably attached to said band and said outer face having a logo applied thereto.

6. A strap logo comprising a band having arms for encircling a book bag strap, and having complementary hook and loop fasteners attached to each of said arms and a logo face having inner and outer faces, said inner face being permanently and rotably attached to said band and said outer face having a logo applied thereto.

* * * * *